US005662756A

United States Patent [19]

Andréen

[11] Patent Number: 5,662,756

[45] Date of Patent: Sep. 2, 1997

[54] METHOD FOR REUSING SCRAPPED, LOOSE MATS

[75] Inventor: Gunnar Andréen, Lund, Sweden

[73] Assignee: S. Berendsen Aktiebolag, Malmo, Sweden

[21] Appl. No.: 436,217

[22] PCT Filed: Nov. 15, 1993

[86] PCT No.: PCT/SE93/00976

§ 371 Date: Jun. 12, 1995

§ 102(e) Date: Jun. 12, 1995

[87] PCT Pub. No.: WO94/10888

PCT Pub. Date: May 26, 1994

[30] Foreign Application Priority Data

Nov. 13, 1992 [SE] Sweden ..... 9203394

[51] Int. Cl.[6] ..... B32B 35/00

[52] U.S. Cl. ..... 156/94; 156/98; 428/86

[58] Field of Search ..... 156/94, 98, 92, 156/153, 276, 290, 292; 428/86, 88, 91, 95; 29/402.09

[56] References Cited

U.S. PATENT DOCUMENTS

| | | | |
|---|---|---|---|
| 2,021,042 | 11/1935 | Bayon | 156/94 |
| 4,766,022 | 8/1988 | Tone . | |
| 4,876,135 | 10/1989 | McIntosh | 428/74 |
| 5,094,905 | 3/1992 | Murray | 156/94 |
| 5,240,530 | 8/1993 | Fink . | |
| 5,413,662 | 5/1995 | Skinner | 156/94 |

FOREIGN PATENT DOCUMENTS

| | | |
|---|---|---|
| 2915622 | 8/1993 | Germany . |

*Primary Examiner*—Daniel Stemmer

*Attorney, Agent, or Firm*—Beveridge, DeGrandi, Weilacher & Young, L.L.P.

[57] ABSTRACT

A method for reusing loose, rejected or scrapped mats (1) of the type having a compact rubber-cloth backing (2) with a textile pile (3) incorporated therein, as well as a circumferential, pile-free backing edge portion (4, 4'), is disclosed. After optionally shaving off pile to produce the circumferential, pile-free backing edge portion, two such mats of essentially the same size, or one such mat and a pile-free rubber cloth of essentially the same size, are put together with the pile sides facing one another, or with the pile side facing the rubber cloth. Then, the edge portions (4, 4') are attached to one another throughout the entire circumference in an air-entrapping manner, whereby to obtain a mat especially suited for use on working sites or in industry.

18 Claims, 1 Drawing Sheet

METHOD FOR REUSING SCRAPPED, LOOSE MATS

This invention relates to a method for reusing loose, rejected or scrapped mats.

Large quantities of small mats, such as entrance mats, are produced, which have a compact backing, usually made of a synthetic rubber cloth with textile fibres or pile incorporated therein, that may form a pattern of some sort, e.g. a company logotype, as well as a circumferential, pile-free edge portion. The mats are scrapped when worn or stained, or when to be replaced with mats having another pattern. It will be appreciated that scrapping has harmful environmental consequences.

The object of the invention is to provide a method for reusing mats of this type.

This object is attained by the method defined in appended claim 1, in which two such mats of essentially the same size are put together with the pile sides facing one another, and the circumferential, pile-free backing edge portions on the pile sides are attached to one another throughout the entire circumference in an air-entrapping manner, whereby to obtain a mat especially suited for use on working sites or in industry.

It has been found that the inventive method yields an ergonomically-compatible mat suited for use on working sites or in industry. Thus, the produced mat is springy owing to the air entrapped therein, as well as soft to walk on owing to the engagement of the two pile sides facing one another. It will be appreciated that the inventive mat is inexpensive to produce compared with ordinary mats for use on working sites or in industry.

In a mode of the invention defined in appended claim 2, some of the pile is removed at the corners close to the pile-free backing edge portion before the mats are joined together. The resulting mat is especially well suited for use on working sites because of its anti-tripping properties.

Mats with synthetic fibre pile as well as mats with natural fibre pile have proved to give the advantageous properties indicated above.

The pile-free edge portions can be attached to one another in various ways obvious to the expert. For instance, they can be glued together or be joined by cold curing when the backing cloth material is curable, with optional interposition of a strip of natural rubber.

Figure 1:
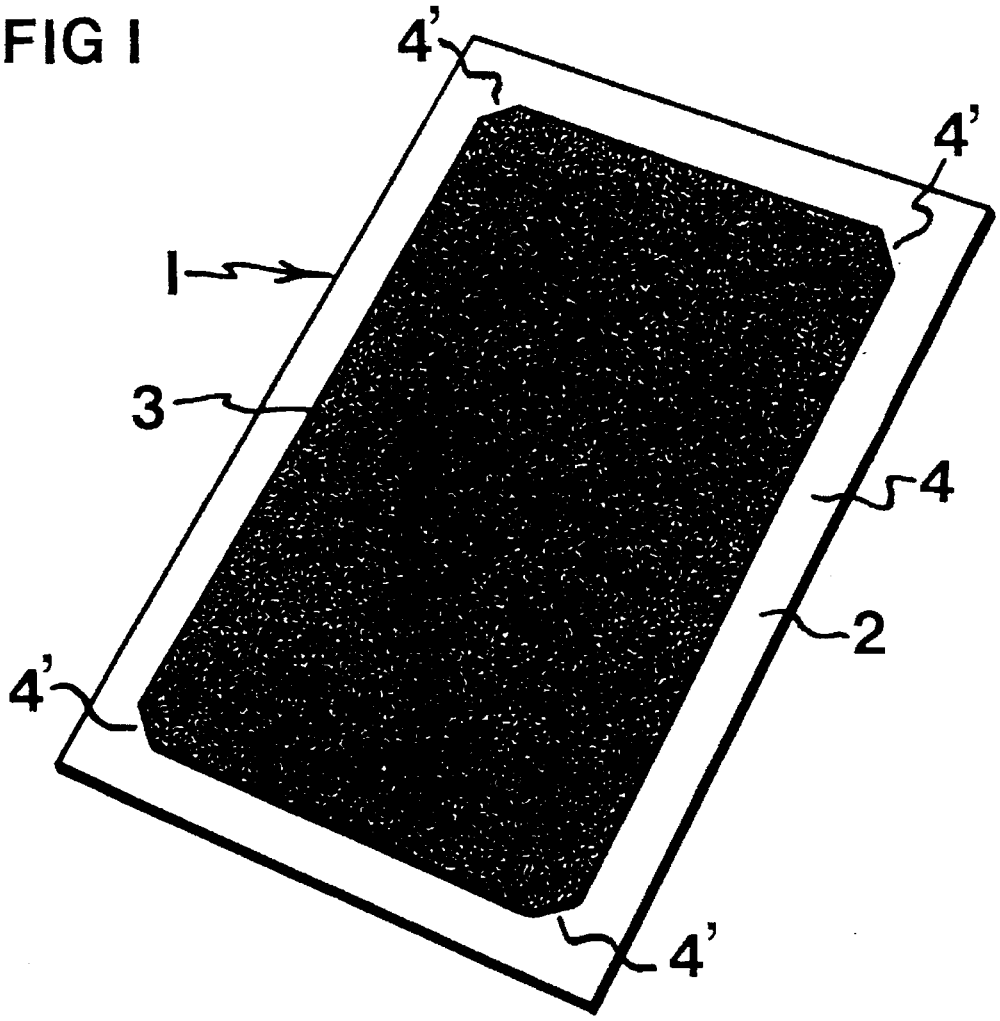
Figure 2:
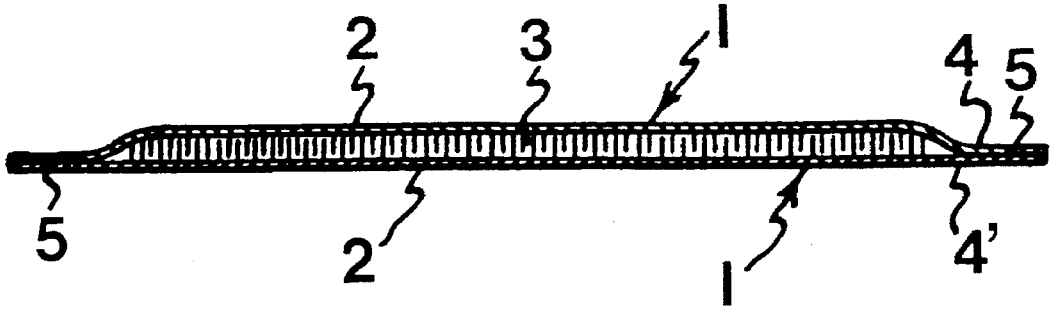

A preferred embodiment of the invention is illustrated in the accompanying drawing, in which FIG. 1 shows a mat prior to attachment, and FIG. 2 is a cross-section of two mats that have been joined together.

Thus, two scrapped equal-sized mats 1, which have a synthetic rubber backing 2 with a pile 3 incorporated therein, as well as a circumferential, pile-free backing edge portion 4, have been put together with the pile sides facing one another. Beforehand, the pile 3 of the two mats 1 has been shaved off in the four corners 4'. The pile-free edge and corner areas 4, 4' have been glued together at 5 at room temperature and under pressure in order to entrap air between the mats. The ergonomically-compatible mat thus produced is ready for use on working sites or in industry. Although air is enclosed between the mats, the inventive product need not be completely airtight. Some mats of the type at issue are perforated with small holes to enable centrifuging off water after washing. In such a case, the enclosed air is gently expelled when people are walking on the joined mats, but the negative pressure then generated results in air being again drawn into the mats.

According to the invention, also mats that have been cut in half may be joined as above with the pile sides facing each other. If so, the cut edge sides are first shaved on the pile side to produce the appearance shown in FIG. 1. Also, the invention encompasses the joining of a mat and a (synthetic) rubber cloth that may be provided with a pattern.

I claim:

1. A method for fabricating a third mat from a first mat and a second mat, said first mat and said second mat being essentially the same size and each having a front surface and a rubber back surface, said front surface of each mat having a textile pile portion incorporated thereon and a pile-free edge portion perimetrically disposed about said textile pile portion and said rubber back surface of each mat being continuous, said method comprising:

arranging said first mat and said second mat such that said pile textile portion of each mat faces one another, and attaching said pile-free edge portion of said first mat to said pile-free edge portion of said second mat.

2. A method for fabricating a third mat from a first mat and a second mat as set forth in claim 1, further comprising, prior to the step of attaching said pile-free edge portions, the step of:

removing an outer portion of said textile pile from said first mat, from said second mat or from both said first and said second mats to prevent said third mat from bulging abruptly.

3. A method for fabricating a third mat from a first mat and a second mat as set forth in claim 1, wherein said attaching step comprises gluing or bonding said pile-free edge portion of said first mat to said pile-free edge portion of said third mat.

4. A method for fabricating a third mat from a first mat and a second mat as set forth in claim 2, wherein said attaching step comprises gluing bonding said pile-free edge portion of said second mat to said pile-free edge portion of said third mat.

5. A method for fabricating a third mat from a first mat and a second mat as set forth in claim 2, wherein, said pile-free edge portion of said first mat is attached to said pile-free edge portion of said second mat such that an air tight interior chamber is defined therebetween.

6. A method for fabricating a third mat from a first mat and a second mat as set forth in claim 1, wherein:

said pile-free edge portion of said first mat is attached to said pile-free edge portion of said second mat such that an air tight interior chamber is defined therebetween.

7. A method for fabricating a third mat from a first mat and a second mat as set forth in claim 1, further comprising, before the step of arranging said first mat and said second mat, the step of:

shaving off a portion of said textile pile portion of said first mat or said second mat to enlarge said pile-free edge portion of said first mat or said second mat.

8. A method for fabricating a third mat from a first mat and a second mat as set forth in claim 2, wherein:

said textile pile is substantially rectangular in shape, and said outer portion comprises a corner portion.

9. A method for fabricating a third mat from a first mat and a second mat, said first mat and said second mat being essentially the same size and each having a front surface and a rubber back surface, said front surface of said first mat having a first textile pile portion incorporated thereon and a pile-free edge portion perimetrically disposed about said textile pile portion, said front surface of said second mat having a second textile pile portion incorporated on a least one edge thereof, and said rubber back surface of each of said mats being continuous, said method comprising:

shaving said second textile pile portion off of said edge of said second mat to produce a pile-free edge portion, arranging said first mat and said second mat with said pile textile portion of said first mat facing said front surface of said second mat, and attaching said pile-free edge portion of said first mat to said pile-free edge portion of said second mat.

10. A method for fabricating a third mat from a first mat and a second mat as set forth in claim 9, further comprising prior to the step of attaching said pile-free edge portions, the step of:

removing an outer portion of said textile pile from said first mat to prevent said third mat from bulging abruptly.

11. A method for fabricating a third mat from a first mat and a second mat as set forth in claim 9, wherein:

said attaching step comprises gluing or curing said pile-free edge portion of said first mat to said pile-free edge portion of said second mat.

12. A method for fabricating a third mat from a first mat and a second mat as set forth in claim 9, wherein, said pile-free edge portion of said first mat is attached to said pile-free edge portion of said second mat such an air tight interior chamber is defined therebetween.

13. A method for fabricating a third mat from a first mat and a second mat as set forth in claim 9, further comprising, before the step of arranging said first mat and said second mat, the step of:

shaving off a portion of said textile pile portion of said first mat to enlarge said pile-free edge portion of said first mat.

14. A method for fabricating a second mat from a first mat and a rubber sheet, said first mat and said rubber sheet being essentially the same size and said first mat having a front surface and a rubber back surface, said front surface having a textile pile portion incorporated thereon and a pile-free edge portion perimetrically disposed about said textile pile portion and said rubber back surface being continuous, said method comprising:

arranging said first mat and said rubber sheet such that said pile textile portion of said first mat faces said rubber sheet, and attaching said pile-free edge portion of said first mat to an edge portion of said rubber sheet.

15. A method for fabricating a second mat from a first mat and a rubber sheet, as set forth in claim 14, wherein:

said pile-free edge portion of said first mat is attached to said pile-free edge portion of said rubber sheet such that an air tight interior chamber is defined therebetween.

16. A method for fabricating a second mat from a first mat and a rubber sheet, as set forth in claim 14, further comprising, before the step of arranging said first mat and said rubber sheet, the step of:

shaving off a portion of said textile pile portion of said first mat to enlarge said pile-free edge portion of said first mat.

17. A method for fabricating a mat from a first mat portion and a first mat portion, said first mat portion and said second mat portion being essentially the same size and each having a front surface and a rubber back surface, said front surface of each mat portion having a textile pile portion incorporated on at least one edge thereof and said rubber back surface of each mat portion being continuous, said method comprising:

shaving said textile pile portion off of said edge of each mat portion to produce a pile-free edge portion on each mat portion, arranging said first mat portion and said second mat portion such that said front surface of said first mat portion faces said front surface of said first mat portion, and attaching said pile-free edge portion of said first mat portion to said pile-free edge portion of said second mat portion.

18. A method for fabricating a mat from a first mat portion and a second mat portion, as set forth in claim 17, wherein:

said first mat portion and said section mat portion are sections severed from a single mat.

* * * * *